US005210942A

United States Patent [19]

Emmerich et al.

[11] Patent Number: 5,210,942

[45] Date of Patent: May 18, 1993

[54] METHOD FOR PRODUCING CABLE HARNESSES

[75] Inventors: Herbert Emmerich, Waiblingen/Neustadt; Gerd Schlaich, Rutesheim, both of Fed. Rep. of Germany

[73] Assignee: MERZ Metall-und Kunststoffverarbeitungs GmbH, Frankfurt am Main, Fed. Rep. of Germany

[21] Appl. No.: 876,897

[22] PCT Filed: Jun. 16, 1989

[86] PCT No.: PCT/DE89/00395

§ 371 Date: Dec. 17, 1990

§ 102(e) Date: Dec. 17, 1990

[87] PCT Pub. No.: WO89/12900

PCT Pub. Date: Dec. 28, 1989

Related U.S. Application Data

[63] Continuation of Ser. No. 623,931, Dec. 17, 1990, abandoned.

[30] Foreign Application Priority Data

Jun. 18, 1988 [DE] Fed. Rep. of Germany ..... 3820637

[51] Int. Cl.[5] ..... H01R 43/04

[52] U.S. Cl. ..... 29/863; 29/748

[58] Field of Search ..... 29/857, 863, 747, 748, 29/755, 564.4

[56] References Cited

U.S. PATENT DOCUMENTS

| | | | |
|---|---|---|---|
| 3,769,701 | 11/1973 | Kloth | 29/755 |
| 4,677,734 | 7/1987 | Bloch et al. | 29/755 |
| 4,831,726 | 5/1989 | Moly | 29/857 |

*Primary Examiner*—P. W. Echols

*Attorney, Agent, or Firm*—Paul & Paul

[57] ABSTRACT

A method for producing cable harnesses particularly by the crimping technique, in which there are disposed on a laying board plug housing holding device between which the individual cables are laid by the use of guides. Plug housing holding device is disposed on one end surface of the laying board in a line while the guides are disposed on the actual working surface of the laying board; the laying board is moved at least one direction; and the attachment of at least one cable end to the contacts is effected by moving the cable end together with the laying board to a rigidly disposed attachment member.

8 Claims, 2 Drawing Sheets

METHOD FOR PRODUCING CABLE HARNESSES

This application is a continuation of application Ser. No. 623,931, filed Dec. 17, 1990 now abandoned.

The invention relates to a method of producing cable harnesses particularly wherein individual conductors are provided with terminal contacts, and in which there are disposed on a laying board plug housing holding means from which or to which the individual conductors are laid with the help of guide means.

At the present time, even with industrial production, most of the operations in the assembly of cable harnesses are carried out manually. It is true that isolated instances of pilot installations have been known in which the cables are laid by means of an industrial robot, however, no system is known in which all the operations can at least in principle be automated.

It is true that there are rigidly automated making-up machines or looping apparatuses, on which cables can be reduced to lengths and provided with crimped contacts at one or both ends. All the operations which follow making-up are, however, usually performed by hand.

In the case of those few pilot installations which have been known, particularly plug fitment is very time intensive, so that productivity is low. Particularly in the case of these pilot systems, firstly the contact is attached (at one end or both) and only then is the conductor automatically laid, the contacts being inserted into the plug housing.

The invention relates to a method of producing cable harnesses in which all the working stages can be automated with a high level of productivity.

According to the invention, of disposing the plug housing holding means is accomplished not on the actual working surface of the laying board but on a boundary surface or edge thereof. On the actual working surface of the laying board, only the guide means which are constructed in known manner are disposed. As a result, it is possible for the apparatus, to be "rigidly" disposed and for the individual cables to be brought into the region of the attachment device in each case by a movement of the laying board. Thus, it is in particular no longer necessary for example for an industrial robot to guide the attachment device so that by virtue of the method according to the invention, it is possible to dispense with an expensive industrial robot which is capable of positioning heavy tools.

Only when using plug types in which insertion of the contact-bearing cable into the plug housing is possible from: only one direction, it may be necessary to use a laying tool which is guided by a multi-axial positioning device. This positioning device moves the cable firstly into the region of the attachment machine and then inserts it into the plug housing, the cable carrying a contact.

It goes without saying, however, that both when using a rigid laying tool such as a laying nozzle, and also when using a laying tool guided by an industrial robot and using the appropriate types of plug, it is possible firstly to fit the cable through the connection of the plug housing and then to move it to the region of a rigidly disposed de-insulating and attachment device. Provided with its contact, the cable is then "inserted" into the plug by being pulled backwards.

Tying-off the cable on the laying board can be carried out with a rigidly disposed tying-off tool or with a laying tool guided by an industrial robot.

BRIEF DESCRIPTION OF THE DRAWING FIGURES

Without limiting the general and underlying idea, the invention will be described in greater detail hereinafter with reference to two embodiments which are shown in the accompanying drawings, in which:

FIG. 1*a* is a side view of a first embodiment; FIGS. 1*b* and 1*c* are front views of the laying board and feed unit, respectively, of the first embodiment; and FIGS. 2*a* and 2*b* are respectively a plan view and a view on the line A—A in FIG. 2*a*, illustrating a second embodiment.

DETAILED DESCRIPTION OF THE PREFERRED EMBODIMENTS

Figure 1A:
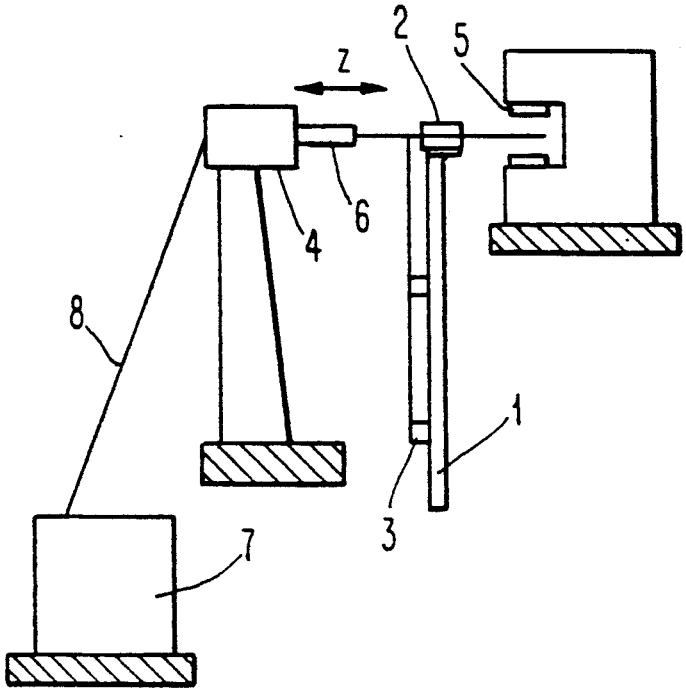
Figure 1C:
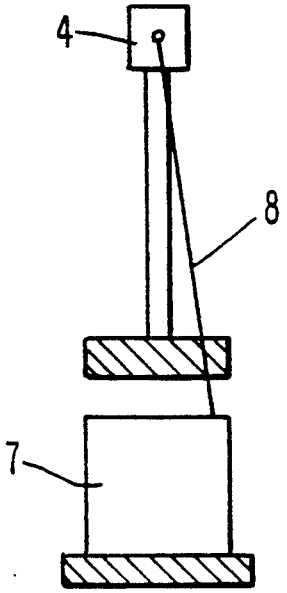
Figure 1B:
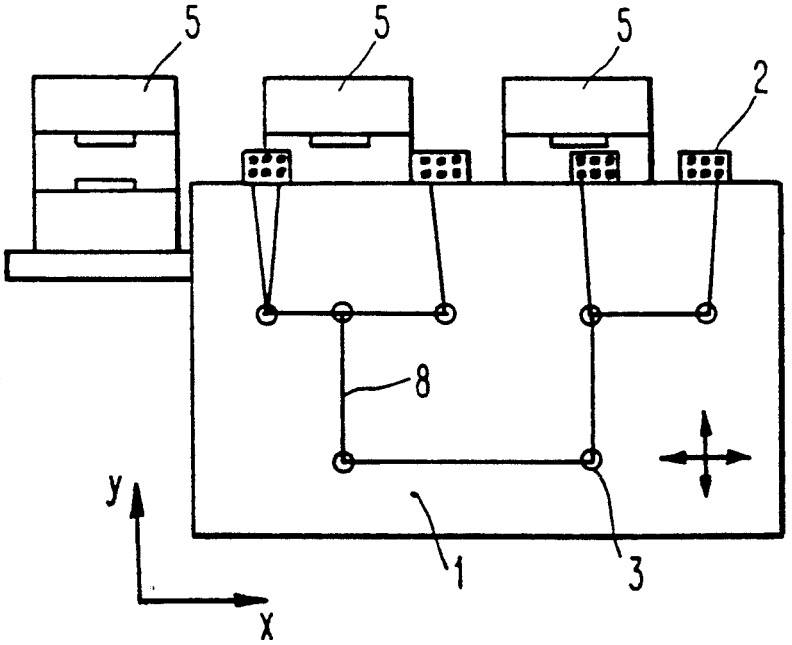

In the case of the embodiment shown in FIGS. 1*a*, 1*b* and 1*c* a laying board 1 is adapted for movement in the x- and y-directions. Without limiting the general idea underlying the invention, the plane extending through the x- and y- directions is a vertical plane in relation to a stationary system.

In contrast to the prior art procedure, the holding means 2 for plug housings of the cable harness are not disposed on the actual working area of the laying board I but on a narrow edge. All that is to be found on the working surface are the so-called guide means 3 for guiding the conductors 8. In front of the laying board and adapted for movement at right-angles to the directions of movement of the laying board is a laying nozzle 6. It goes without saying that it is possible, when laying conductors of differing cross-section and/or color, to provide a series of laying nozzles. Provided on the laying nozzle 6 is a conductor feed unit 4. The unit 4 is capable of moving a conductor 8 which is drawn from a cable drum 7 both forward and backwards, i.e. in the two directions indicated by the double-headed arrow z.

Behind the laying board are various units 5 which de-insulate the cables and which are required to attach the necessary terminal contacts to the cables.

In FIGS. 1*b*, these units are shown offset to the actual laying unit 6 but it goes without saying that they can also be aligned and/or constructed to be displaceable in the x-direction.

Furthermore, there is in the region of the laying board an automatic device for holding parts ready, for plug connectors, cable ties, etc., which are not shown in FIG. 1.

From this preparation unit, the holding means 2 on the top of the laying board 1 can be provided with the appropriate plug housings.

The handling movement between the parts preparation system and the laying board I may be effected either by a separate industrial robot (likewise not shown) or by pneumatic, hydraulic or electric handling modules.

The manner in which the apparatus described functions will be explained hereinafter:

Firstly, the means 2 on the upper edge of the vertically disposed laying board are provided with the appropriate plug housings. Then the laying board is positioned in front of a laying nozzle which shoots (fits) a conductor from the laying nozzle through a contact chamber of a plug housing. The conductor which is shot through is de-insulated in a de-insulating and attachment device 5 provided above and behind the movable laying board and provided with a terminal contact. To this end, the said de-insulating and attachment device 5 are disposed at the same height as the plug connectors present in the holders.

Once the contacts have been fitted, the conductor 8 which is now prepared at one end is by means of the feed unit 4 provided in the region of the laying nozzle (which is adapted for movement in two directions) pulled back so that the terminal contact automatically engages into a plug housing. Now the conductor 8 is laid by a bi-axial x-y movement of the laying board 1. Once the conductor 8 has been laid, the second conductor end is cut off in the laying nozzle 6 and the second end of the conductor 8 is either de-insulated manually and provided with terminal contacts or they are insulated and provided with terminal contacts by means of an industrial robot. The cable harness can be bundled either manually or also fully automatically, for example by means of an automatically operated tying-off gun (not shown). Furthermore, it is also possible to use a rigidly disposed tying-off gun.

If only one type of terminal contact is to be used, then it is advantageous for the laying nozzle 6 to be fitted directly in front of the associated attachment machine 5. In this case, the laying nozzle only has to be moved in one axis which is movable at right-angles to the two axes of the laying board.

If a plurality of types of terminal contact 5 are to be used, then either the laying nozzles 6 or the attachment machines 5 must be mounted on an axis which is movable in the x-direction so that any desired conductors can be combined with any desired contacts. Also in this case, the laying nozzles 6 are movable in the z-direction in order to be able to carry out appropriate deflecting movements.

Furthermore, the feed unit 4 also has the function of clamping the conductor 8 securely during the attachment process. Furthermore, the mobility in the z-direction of the units 4 and 6 guarantees that when the conductor 8 is being threaded into the plug connector, the least possible gap is maintained between the individual elements. On the other hand, due to the conductor 8 being advanced in the z-direction, the conductor is fed through plug connectors and into the appropriate insulating or attachment machine.

In any case, the apparatus according to the invention or the method which can be performed by this apparatus have the advantage that conductors can be laid fully automatically.

Figure 2A:
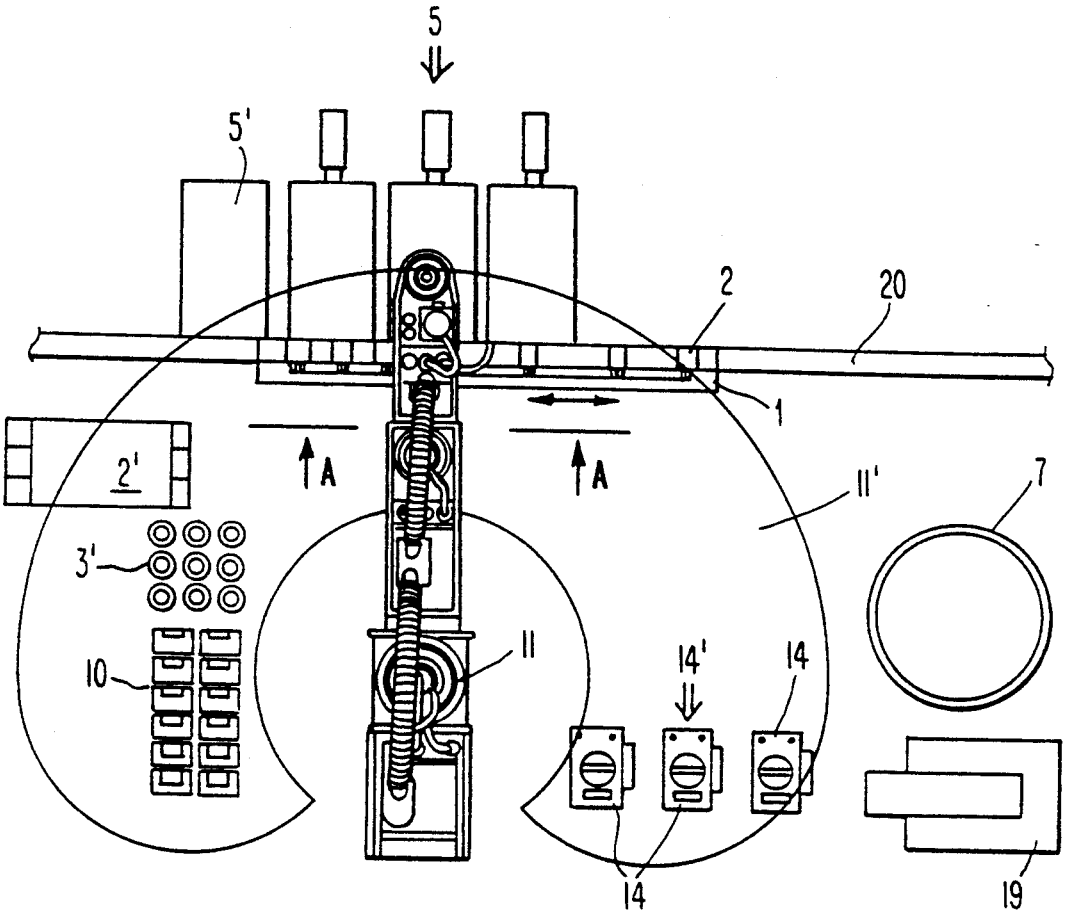
Figure 2B:
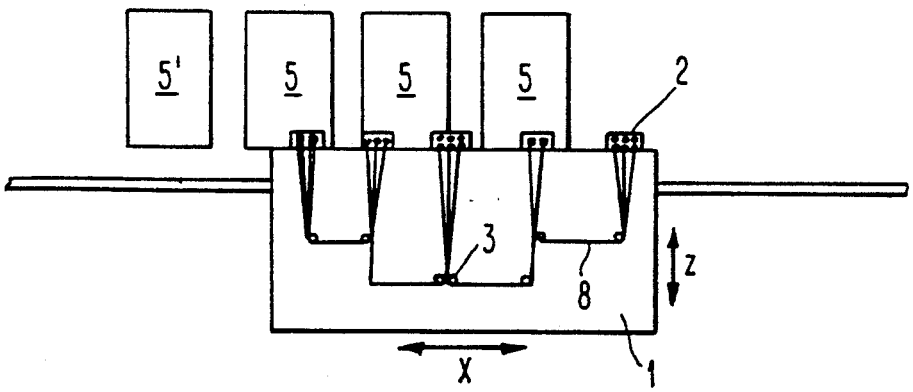

FIGS. 2*a* and 2*b* show a further example of an embodiment of the invention. In this example, all the parts which correspond to parts in the embodiment shown in FIG. 1 are identified by the same reference numerals.

In contrast to the embodiment shown in FIG. 1, that shown in FIG. 2 has no laying nozzle but instead an industrial robot 11 is provided and this has the working zone 11'. The industrial robot 11 takes tools 14 such as for example laying tools, including grippers from a corresponding magazine 14' and uses these tools 14 in turn to lay the cable 8 which is taken from a cable drum 7.

The difference in the way this apparatus functions will be described hereinafter.

By way of preparation, the configuration of the cable harness to be produced can for example be input in a CAD workplace and so converted by means of a computer program that all the plug housings come to be positioned in one line.

The multi-axial positioning unit (industrial robot) 11 positions the plug housing holding means 2 held ready in a corresponding magazine 2' on the top edge of the laying board 1 which is in turn disposed vertically. Then, the industrial robot positions on the actual working surface the laying aids 3 taken from a magazine 14'.

Once these preparatory steps have been concluded, the industrial robot 11, using a gripper 3, loads the holding means 2 on the laying board 1 with plug housings which are held ready in a magazine 10.

Then the industrial robot 11 takes a laying tool from the magazine 14', moves it to the de-insulating device 5' so that the cable end guided by the laying tool can be de-insulated. The next step is for the industrial robot to move to an attachment device which applies a crimped contact to the de-insulated cable end.

Then, using the laying tool, the robot takes the attached cable end and lays the cable in accordance with the path preset by the control unit. The cable 8 is thereby pulled out of the cable drum 7 by the laying tool.

When the second plug housing is reached, the cable is cut off in the tool. The industrial robot 11 and the laying board i perform a synchronous movement to the de-insulating device 5' and then to the rigidly installed attachment means 5.

According the the type of plug housing involved, firstly the cable is provided with its contact at the attachment machine and then joined by means of the industrial robot or the cable is pushed through the plug housing, provided with a contact and then pulled back into the plug housing.

In the laying tool, further cable is advanced and the laying and contact making process in respect of the further cables is performed as already described.

Once all the cables have been laid, the robot withdraws a tying-off tool from the tool changing magazine 14'. The cable harness is tied off at the locations determined by the control unit, the cable ties being made available to the tying-off tool by a cable tie feeder 19 which is at hand.

The invention has been described hereinabove with reference to examples of embodiment and implying no limitation of the general idea underlying the invention but it goes without saying that all manner of modifications are possible within its scope.

For example, it is possible to combine the basic idea of the first embodiment—the use of a fixed laying nozzle—with the basic idea of the second embodiment—laying the cables by means of an industrial robot. In particular, the free cable ends created in the case of the first embodiment can be automatically laid by a device which is constructed in accordance with the second embodiment. All that is needed is for the second embodiment to be so converted that the cables are not taken from a cable drum; instead, the laying tool grips the free cable ends and otherwise proceeds accordingly.

For example, it is possible to dispose the laying board on a conveyor belt 20 which transports the laying board between the individual processing stations.

In any case, the method according to the invention and the apparatus according to the invention, by using a laying board which is adapted for movement in two directions and on the narrow side of which the plug housing holding means are disposed, have the advantage that both cable ends can be provided with crimped contacts and inserted into plug housings without a prefabricated cable having to be created or enjoy interim storage, in that due to the "upright" disposition of the laying board, the working distance between the laying tool and the plug and the attachment device is minimized.

We claim:

1. A method of producing cable harnesses, wherein individual conductors are provided with terminal contacts, in which there are disposed edgewise on a laying board plug housing holding means from which or to which the individual conductors are laid with the help of guide means, comprising the steps of:

1) disposing the plug housing holding means on one edge surface of the laying board in a line while the guide means are disposed on the actual working surface of the laying board;
2) laying a conductor by moving the laying board in two directions parallel to the plane defined by said laying board; and
3) effecting the attachment of at least one conductor end to a terminal contact by moving the conductor end together with the laying board to a rigidly disposed attachment means.

2. A method according to claim 1, further including the steps of:

1) positioning a laying tool above the face of the laying board;
2) positioning a device for removing insulation and at least one attachment device behind said laying board; and
3) laying an individual conductor through said plug housing holding means and bringing the end of said conductor into alignment with said device for removing insulation and an attachment device by movement of the laying board in two directions substantially perpendicular to each other.

3. A method according to claim 1, characterized in that the conductors are further laid by means of a multi-axial positioning device which guides a laying tool.

4. A method according to claim 3, characterized in that prior to insertion in the plug housing holding means the conductor is provided with a contact by a movement of the multi-axial positioning device to the rigidly disposed attachment means.

5. A method according to one of claim s 1, 2 or 3, characterized in that the conductor is fitted through the connection on the plug housing holding means and is then de-insulated and provided with its contact.

6. A method according to one of claim 1, 2, 3, or 4 characterized in that after laying of the conductor, the second end of the conductor is likewise de-insulated, attached and inserted into the plug housing.

7. A method according to one of claims 1, 2, 3 or 4, characterized in that the conductors are tied on the laying board.

8. A method according to claim 7, characterized in that the cables are tied off at locations which are determined by a control unit.

* * * * *